US008862436B2

(12) United States Patent
Samuel

(10) Patent No.: US 8,862,436 B2
(45) Date of Patent: Oct. 14, 2014

(54) SYSTEMS AND METHODS FOR MODELING WELLBORE TRAJECTORIES

(75) Inventor: Robello Samuel, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 1048 days.

(21) Appl. No.: 12/145,376

(22) Filed: Jun. 24, 2008

(65) Prior Publication Data

US 2009/0319241 A1 Dec. 24, 2009

(51) Int. Cl.

| | |
|---|---|
| ***G06F 17/50*** | (2006.01) |
| ***G06F 17/11*** | (2006.01) |
| ***G06G 7/48*** | (2006.01) |

(52) U.S. Cl.

USPC ..... 703/1; 703/2; 703/10

(58) Field of Classification Search

CPC ..... E21B 41/0092

See application file for complete search history.

(56) References Cited

U.S. PATENT DOCUMENTS

| | | | | |
|---|---|---|---|---|
| 4,773,488 | A * | 9/1988 | Bell et al. | 175/61 |
| 5,103,920 | A | 4/1992 | Patton | |
| 6,757,613 | B2 * | 6/2004 | Chapman et al. | 702/6 |
| 2005/0149306 | A1 * | 7/2005 | King | 703/10 |
| 2006/0028038 | A1 | 2/2006 | Glasgow et al. | |
| 2006/0243496 | A1 | 11/2006 | Widmann | |
| 2008/0314641 | A1 * | 12/2008 | McClard | 175/57 |

OTHER PUBLICATIONS

Gulyaev et al. "Computer Simulation of Resistance Forces Acting Upon Curvilinear Drill Strings", 2007, Strength of Materials, vol. 39, No. 5, pp. 492-501.*

Aadnoy et al. "Design of oil wells using analytical friction models", 2001, Journel of Petroleum Science and Engineering, 32, pp. 53-71.*

Walton et al. "A controlled clothoid spline", 2005, Comptuers & Graphics 29, pp. 353-363.*

Paradigm, "sysdrill 3.0 Release Notes", 2007, 39 pages.*

Article 34 Response, PCT/US09/48095, Jan. 24, 2010, 7 pages.

Fresnel Integral; Wikipedia; Mar. 28, 2008; 3 pages; Wikimedia Foundation, Inc.

Johancsik, C.A., Friesen, D.B. & Dawson, Rapier; Torque and Drag in Directional Wells—Prediction and Measurement; Journal of Petroleum Technology; Jun. 1984; pp. 987-992; Society of Petroleum Engineers of AIME.

Sheppard, M.C., Wick, C. & Burgess, T.; Designing Well Paths to Reduce Drag and Torque; SPE Drilling Engineering; Dec. 1987; pp. 334-350; Society of Petroleum Engineers.

Horn, B.K.P.; The Curve of Least Energy; Massachusetts Institute of Technology-Artificial Intelligence Laboratory; Jan. 1981, revised Mar. 1983; 34 pages.

Brandse, J., Mulder, M. & Van Paassen, M.M.; Clothoid-Augmented Trajectories for Perspective Flight-Path Displays; The International Journal of Aviation Psychology; 2007; pp. 1-29; vol. 17, Issue 1; Lawrence Erlbaum Associates, Inc.

International Search Report & Written Opinion for International Patent Application No. PCT/US2009/48095; Jul. 31, 2009; 9 pgs.; Commissioner for Patents; Alexandra, Virginia.

(Continued)

*Primary Examiner* — S Lo

(74) *Attorney, Agent, or Firm* — Crain, Caton & James; Benjamin Fite

(57) ABSTRACT

Systems and methods for modeling wellbore trajectories using curvature bridging functions. The systems and methods use a clothoid spiral as a bridging curve in the transition zones to reduce tubular stresses/failures in the design of multilateral well paths and extended reach well paths.

22 Claims, 6 Drawing Sheets

(56) References Cited

OTHER PUBLICATIONS

Makela, Hannu; Outdoor Navigation of Mobile Robots; PhD Dissertation; Nov. 30, 2001; 71 pgs.; Helsinki University of Technology.

Shah, Kamina; International Preliminary Report on Patentability; May 12, 2011; 9 pgs.; Commissioner for Patents; Alexandria, Virginia.

* cited by examiner

SYSTEMS AND METHODS FOR MODELING WELLBORE TRAJECTORIES

CROSS-REFERENCE TO RELATED APPLICATIONS

Not applicable.

STATEMENT REGARDING FEDERALLY SPONSORED RESEARCH

Not applicable.

FIELD OF THE INVENTION

The present invention generally relates to modeling wellbore trajectories. More particularly, the present invention relates to the use of curvature bridging functions to model wellbore trajectories.

BACKGROUND OF THE INVENTION

Wellbore trajectory models are used for two distinct purposes. The first use is planning the well location, which consists of determining kick-off points, build and drop rates, and straight sections needed to reach a specified target. The second use is to integrate measured inclination and azimuth angles to determine a well's location.

Various trajectory models have been proposed, with varying degrees of smoothness. The simplest model, the tangential model, consists of straight line sections. Thus, the slope of this model is discontinuous at survey points. All conventional methods of wellbore trajectory calculations are based on assumptions and most of them, in each course, are straight lines, polygonal lines, cylinder helixes, or circular arcs. Another common model is the minimum curvature model, which consists of circular arcs. This model has continuous slope, but discontinuous curvature. Analysis of drillstring loads is typically done with drillstring computer models. By far the most common method for drillstring analysis is the "torque-drag" model originally described in the Society of Petroleum Engineers article "Torque and Drag in Directional Wells—Prediction and Measurement" by Johancsik, C. A., Dawson, R. and Friesen, D. B., which was later translated into differential equation form as described in the article "Designing Well Paths to Reduce Drag and Torque" by Sheppard, M. C., Wick, C. and Burgess, T.

Torque-drag modeling refers to the calculation of additional load during tripping in and tripping out operations where torque is due to rotation of the drillstring. Drag is the excess load compared to rotating drillstring weight, which may be either positive when pulling the drillstring or negative while sliding into the well. This drag force is attributed to friction generated by drillstring contact with the wellbore. When rotating, this same friction will reduce the surface torque transmitted to the bit. Being able to estimate the friction forces is useful when planning a well or analysis afterwards. Because of the simplicity and general availability of the torque-drag model, it has been used extensively for planning and in the field. Field experience indicates that this model generally gives good results for many wells, but sometimes performs poorly.

In the standard torque-drag model, the drillstring trajectory is assumed to be the same as the wellbore trajectory, which is a reasonable assumption considering that surveys are taken within the drillstring. Contact with the wellbore is assumed to be continuous. However, given that the most common method for determining the wellbore trajectory is the minimum curvature method, the wellbore shape is less than ideal because the bending moment is not continuous and smooth at survey points. This problem is dealt with by neglecting bending moment but, as a result of this assumption, some of the contact force is also neglected.

Usually, wellbore trajectories are designed with constant-curvature well defined arcs that act as the transition between the tangent sections of a well path. The transition curves are defined as the curve segments connecting the tangent section of the well path to the build or drop sections of the well path. While the transition between the tangent section and build section or the tangent section and the drop section may appear to be smooth, there may be discontinuity causing various stresses in the tubulars. A discontinuity, for example, is apparent when two circular arcs and one tangent section or a circular arc and a tangent section are used for the well path profile. To avoid this problem, continuous build or drop sections are planned. However, even with these designs, there exists a discontinuity in the transition zones.

Therefore, there is a need for a new wellbore trajectory model that is capable of bridging curves (discontinuity) in the transition zones and may be used with other models, such as the standard torque-drag model, in the design of extended and ultra-extended well paths. There is also need for a new wellbore trajectory model that not only is capable of bridging curves in the transition zones, but also reduces tubular stresses/failures and can be used for designing multilateral well paths.

SUMMARY OF THE INVENTION

The present invention therefore, meets the above needs and overcomes one or more deficiencies in the prior art by providing systems and methods for designing a well path that includes a clothoid spiral.

In one embodiment, the present invention includes a well path, which comprises: i) a kick-off point; ii) a hold section; and iii) a clothoid spiral between the kick-off point and the hold section, the clothoid spiral being based on: a) one or more boundary conditions for the well path; b) North, East and depth coordinates of the well path calculated using a general expression for the clothoid spiral; and (c) a measured depth of the well path calculated using the general expression for the clothoid spiral.

In another embodiment, the present invention includes a method for designing a well path with a clothoid spiral, which comprises i) defining a general expression for the clothoid spiral using a computer processor; ii) defining one or more boundary conditions for the well path; iii) calculating North, East and depth coordinates of the well path using the general expression for the clothoid spiral; (iii) calculating a measured depth of the well path sing the general expression for the clothoid spiral; (iv) calculating curvatures in the well path using the measured depth of the well path; and (v) calculating torsion in the well path using the measured depth of the well path.

In yet another embodiment, the present invention includes a non-transitory program storage device tangibly carrying computer executable instructions for designing a well path with a clothoid spiral. The instructions are executable to implement: i) defining a general expression for the clothoid spiral; ii) defining one or more boundary conditions for the well path; iii) calculating North, East and depth coordinates of the well path using the general expression for the clothoid spiral; iv) calculating a measured depth of the well path using the general expression for the clothoid spiral; v) calculating curvatures in the well path using the measured depth of the well path; and vi) calculating torsion in the well path using the measured depth of the well path.

In yet another embodiment, the present invention includes a method for designing a clothoid spiral section for a well path, which comprises i) defining a general expression for the clothoid spiral section using a computer processor; ii) defining one or more boundary conditions for the well path; iii) calculating North, East and depth coordinates of the well path using the general expression for the clothoid spiral section; and iv) calculating a measured depth of the well path using the general expression for the clothoid spiral section.

In yet another embodiment, the present invention includes a non-transitory program storage device tangibly carrying computer executable instructions for designing a clothoid spiral section for a well path. The instructions are executable to implement: i) defining a general expression for the clothoid spiral section; ii) defining one or more boundary conditions for the well path; iii) calculating North, East and depth coordinates of the well path using the general expression for the clothoid spiral section; and iv) calculating a measured depth of the well path using the general expression for the clothoid spiral section.

Additional aspects, advantages and embodiments of the invention will become apparent to those skilled in the art from the following description of the various embodiments and related drawings.

BRIEF DESCRIPTION OF THE DRAWINGS

The present invention is described below with references to the accompanying drawings in which like elements are referenced with like reference numerals, and in which.

DETAILED DESCRIPTION OF THE PREFERRED EMBODIMENTS

The subject matter of the present invention is described with specificity, however, the description itself is not intended to limit the scope of the invention. The subject matter thus, might also be embodied in other ways, to include different steps or combinations of steps similar to the ones described herein, in conjunction with other present or future technologies. Moreover, although the term "step" may be used herein to describe different elements of methods employed, the term should not be interpreted as implying any particular order among or between various steps herein disclosed unless otherwise expressly limited by the description to a particular order.

System Description

The present invention may be implemented through a computer-executable program of instructions, such as program modules, generally referred to as software applications or application programs executed by a computer. The software may include, for example, routines, programs, objects, components, and data structures that perform particular tasks or implement particular abstract data types. The software forms an interface to allow a computer to react according to a source of input. WELLPLAN™, which is a commercial software application marketed by Landmark Graphics Corporation, may be used as an interface application to implement the present invention. The software may also cooperate with other code segments to initiate a variety of tasks in response to data received in conjunction with the source of the received data. The software may be stored onto any variety of memory media such as CD-ROM, magnetic disk, bubble memory and semiconductor memory (e.g., various types of RAM or ROM). Furthermore, the software and its results may be transmitted over a variety of carrier media such as optical fiber, metallic wire, free space and/or through any of a variety of networks such as the Internet.

Moreover, those skilled in the art will appreciate that the invention may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present invention. The invention may be practiced in distributed-computing environments where tasks are performed by remote-processing devices that are linked through a communications network. In a distributed-computing environment, program modules may be located in both local and remote computer-storage media including memory storage devices. The present invention may therefore, be implemented in connection with various hardware, software or a combination thereof, in a computer system or other processing system.

Figure 1:
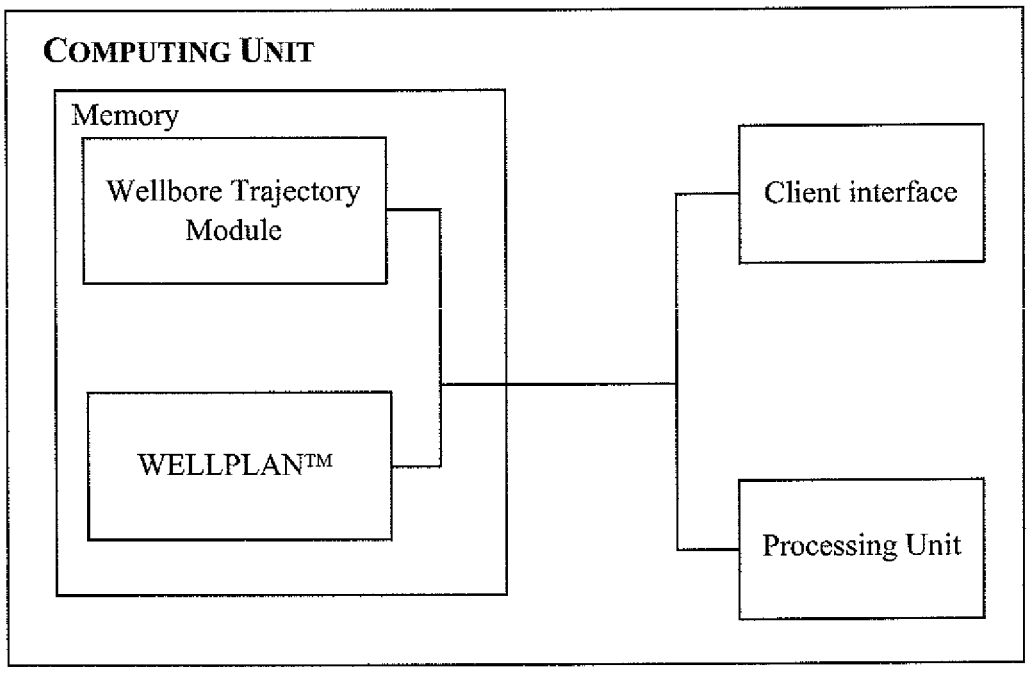
FIG. 1 is a block diagram illustrating a system for implementing the present invention.

Referring now to FIG. 1, a block diagram of a system for implementing the present invention on a computer is illustrated. The system includes a computing unit, sometimes referred to a computing system, which contains memory, application programs, a client interface, and a processing unit. The computing unit is only one example of a suitable computing environment and is not intended to suggest any limitation as to the scope of use or functionality of the invention.

The memory primarily stores the application programs, which may also be described as program modules containing computer-executable instructions, executed by the computing unit for implementing the present invention described herein and illustrated in FIGS. 2-7. The memory therefore, includes a wellbore trajectory module, which enables the methods illustrated and described in reference to FIGS. 2-7, and WELLPLAN™.

Although the computing unit is shown as having a generalized memory, the computing unit typically includes a variety of computer readable media. By way of example, and not limitation, computer readable media may comprise computer storage media and communication media. The computing system memory may include computer storage media in the form of volatile and/or nonvolatile memory such as a read only memory (ROM) and random access memory (RAM). A basic input/output system (BIOS), containing the basic routines that help to transfer information between elements within the computing unit, such as during start-up, is typically stored in ROM. The RAM typically contains data and/or program modules that are immediately accessible to and/or presently being operated on by the processing unit. By way of example, and not limitation, the computing unit includes an operating system, application programs, other program modules, and program data.

The components shown in the memory may also be included in other removable/nonremovable, volatile/non-volatile computer storage media. For example only, a hard disk drive may read from or write to nonremovable, nonvolatile magnetic media, a magnetic disk drive may read from or write to a removable non-volatile magnetic disk, and an optical disk drive may read from or write to a removable, non-volatile optical disk such as a CD ROM or other optical media. Other removable/non-removable, volatile/non-volatile computer storage media that can be used in the exemplary operating environment may include, but are not limited to, magnetic tape cassettes, flash memory cards, digital versatile disks, digital video tape, solid state RAM, solid state ROM, and the like. The drives and their associated computer storage media discussed above provide storage of computer readable instructions, data structures, program modules and other data for the computing unit.

A client may enter commands and information into the computing unit through the client interface, which may be input devices such as a keyboard and pointing device, commonly referred to as a mouse, trackball or touch pad. Input devices may include a microphone, joystick, satellite dish, scanner, or the like.

These and other input devices are often connected to the processing unit through the client interface that is coupled to a system bus, but may be connected by other interface and bus structures, such as a parallel port or a universal serial bus (USB). A monitor or other type of display device may be connected to the system bus via an interface, such as a video interface. In addition to the monitor, computers may also include other peripheral output devices such as speakers and printer, which may be connected through an output peripheral interface.

Although many other internal components of the computing unit are not shown, those of ordinary skill in the art will appreciate that such components and their interconnection are well known.

The nomenclature used herein is described in Table 1 below.

TABLE 1

| Nomenclature | |
|---|---|
| R | radius of curvature |
| O | center of curvature |
| L | length of curve |
| κ | curvature |
| σ | sharpness of the curve |
| s | arch length of curve |
| ξ | characteristic parameter |
| u | parameter |
| l | Length |
| $C_r$ | cosine integral |
| $S_r$ | sine integral |
| τ | Torsion |
| $D_a$ | vertical depth to the kick-off point |
| $\Delta L_l$ | measured depth to the kick-off point |
| α | inclination angle |
| H | horizontal departure |
| g | well path target depth |
| n | total survey stations |
| dL | differential length of the curve |
| ΔD | incremental depth |

TABLE 1-continued

| Nomenclature | |
|---|---|
| ΔH | incremental horizontal departure |
| T | target point |
| i | survey station |
| D | vertical depth |

In the past, several mathematicians and physicists have studied the properties of curves. The Cornu spiral or the Euler spiral (also known as linarc) are of particular interest due to the very nature of the special properties of this type of curve. In fact, Euler described several properties for this type of curve, including the curve's quadrature, which is also widely called a Fresnel spiral. This curve is one type of bridging curve that is referred to herein as a clothoid spiral.

Clothoid spirals are curves with curvatures that change linearly from zero to a desired curvature with respect to the arc length. The radius of curvature at any point of the curve varies as the inverse of the arc length from the starting point of the curve:

$$R \propto \frac{1}{L} \text{ or } L_1 \times R_1 = L_2 \times R_2 = \ldots = L_n \times R_n = \sigma \tag{1}$$

$$\kappa(s) = \kappa(0) + \sigma s \tag{2}$$

In other words, the clothoid spiral is a curve whose curvature is proportionate to its arc length. The clothoid spiral can be parametrically represented as:

$$f(l) = (C_r(l), S_r(l)) \tag{3}$$

$$C_r(l) = \xi \int_0^l \cos\left(\frac{\pi u^2}{2}\right) du \tag{4}$$

$$S_r(l) = \xi \int_0^l \sin\left(\frac{\pi u^2}{2}\right) du \tag{5}$$

The following are called the Fresnel Sine and Cosine Integrals:

$$FresnelC_r(l) = \int_0^l \cos\left(\frac{\pi u^2}{2}\right) du \tag{6}$$

$$FresnelS_r(l) == \int_0^l \sin\left(\frac{\pi u^2}{2}\right) du \tag{7}$$

Since it is not possible to obtain a closed form solution to the above equations, several approximate numerical computations have been presented in the literature using Taylor, Power Series and Maclaurian expansions. J. Brandse, M. Mulder, and M. M. van Paassen in their paper "Clothoid-Augmented Trajectories for Perspective Flight-Path Display," which is well known in the art and incorporated herein by reference, obtained a simple expression using Maclaurian expansion, and the coordinates can be expressed in terms of the length of the spiral arc as follows:

$$y = \frac{L^3}{6\xi^2} - \frac{L^7}{336\xi^6} + \frac{L^{11}}{42240\xi^{10}} + \ldots \tag{8}$$

$$x = L - \frac{L^5}{40\xi^4} + \frac{L^9}{3456\xi^{10}} + \ldots \tag{9}$$

If higher order terms are omitted, then equations 8 and 9 may be written in the following manner, which is a cubic parabola in nature:

$$y=(6\xi^2 x)^{1/3} \tag{10}$$

Based on the properties of the clothoid spiral, the relationship between the curvature and the scale parameter may be represented as:

$$L_1 \times R_1 = L_2 \times R_2 = \ldots = L_n \times R_n = \xi^2 \tag{11}$$

EXAMPLES

Figure 2:
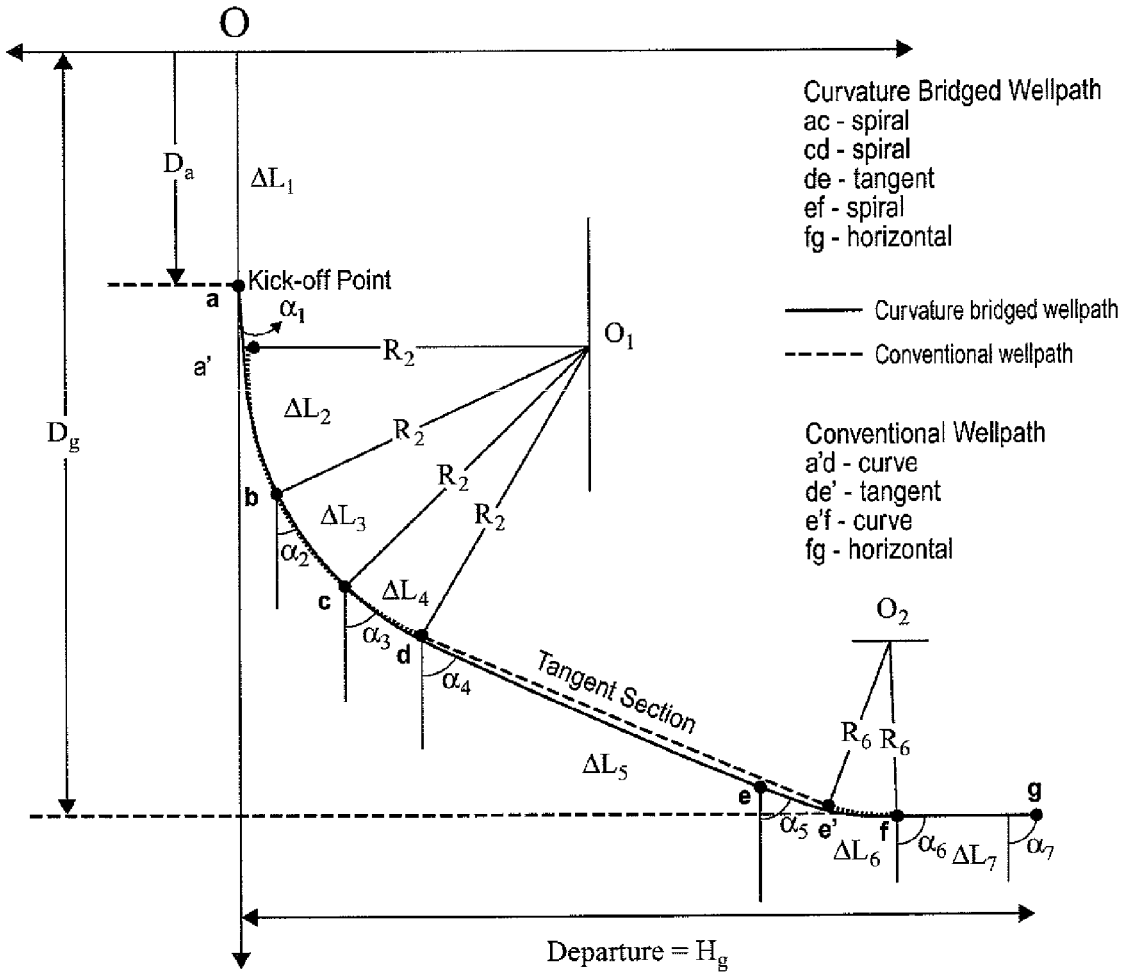
FIG. 2 is an illustration of an exemplary well path with clothoid spiral bridging curves.

An exemplary well path with clothoid spiral bridging curves is illustrated as a solid line in FIG. 2 and is compared to a conventional well path (dotted line) without clothoid spiral bridging curves. It can be seen that the well path consists of the following sections:

- Clothoid spiral from the kick-off point ($\Delta L_2$)
- Clothoid spiral (circular arc section) with maximum curvature $\kappa_{max}$ ($\Delta L_3$)
- Clothoid spiral including partial tangent section ($\Delta L_4$)
- Partial tangent section ($\Delta L_5$)
- Clothoid spiral including partial hold section ($\Delta L_6$)
- Hold section ($\Delta L_7$)

Although the tangent section and the hold section are illustrated as separate sections in this example, they may be the same section. In other words, a hold section may be a tangent section in other examples.

Figure 3A:
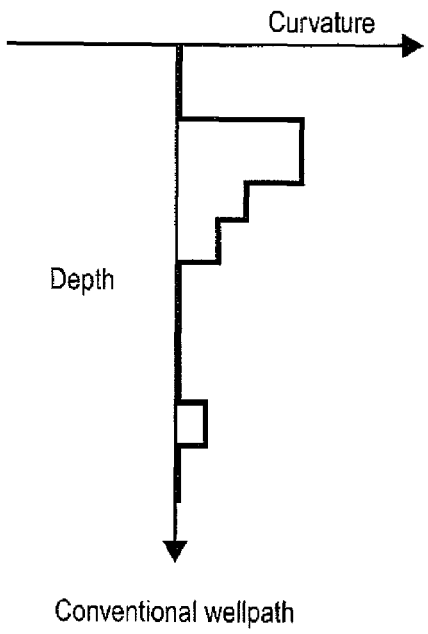
FIG. 3A is an illustration of a conventional well path design without clothoid spiral bridging curves.
Figure 3B:
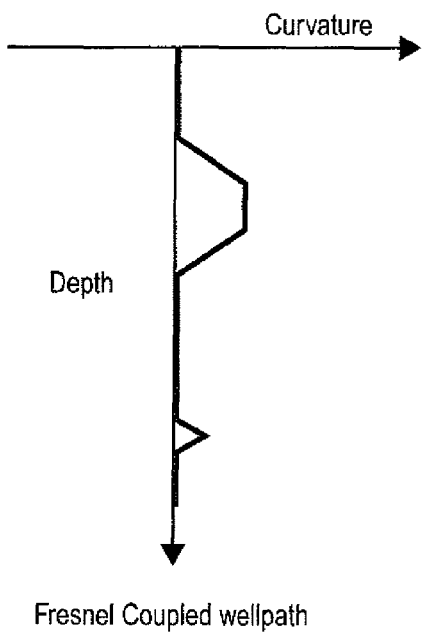
FIG. 3B is an illustration of the well path in FIG. 3A, which is designed with clothoid spiral bridging curves.

Referring now to FIG. 3A, a conventional well path design is illustrated without clothoid spiral bridging curves. In FIG. 3B, the well path in FIG. 3A is redesigned to use clothoid spiral bridging curves as explained before, which are curves with curvatures that change linearly from zero to a desired curvature with respect to the arc length. As illustrated by the comparison of FIG. 3A with FIG. 3B, the curvature bridging in FIG. 3B is smooth.

Figure 4:
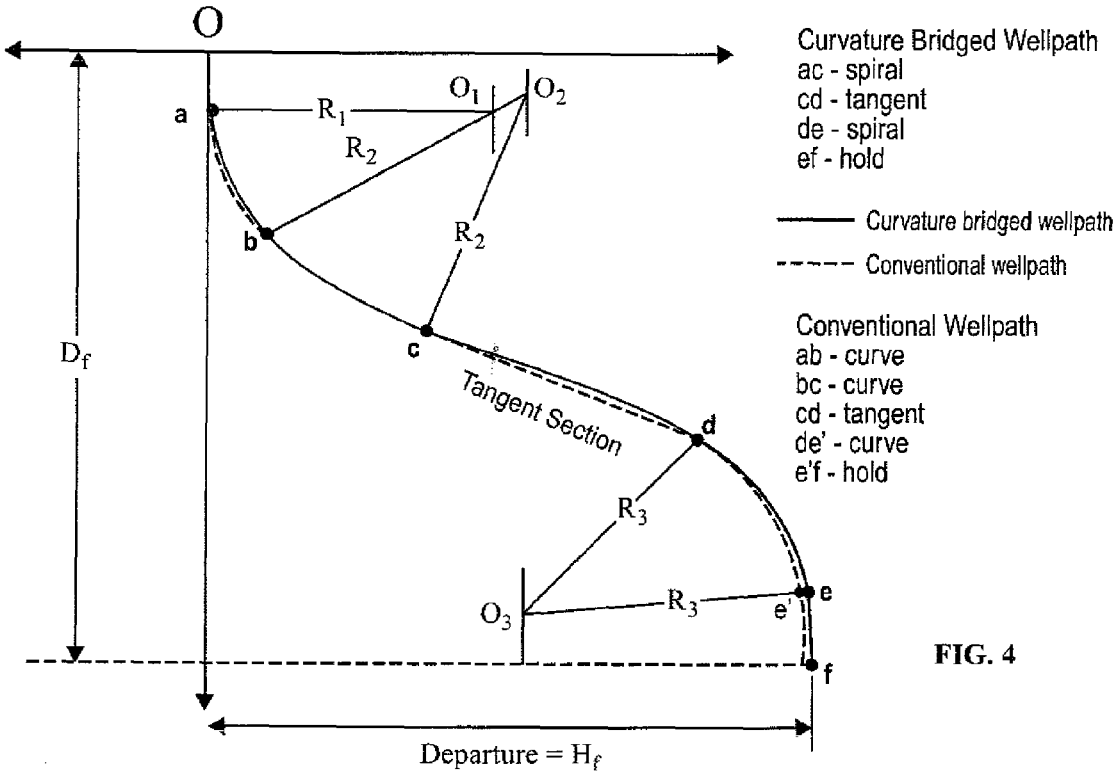
FIG. 4 is an illustration of a exemplary S-type well path with clothoid spiral bridging curves.

Referring now to FIG. 4, an exemplary S-type well path is illustrated as a solid line with clothoid spiral bridging curves and is compared to a conventional well path (dotted line) without clothoid spiral bridging curves. Therefore, FIG. 4 incorporates, in part, a commonly used well path profile and clothoid spiral bridging curves. The well path consists of the following sections:

- Clothoid spiral from the kick-off point: build section (a-b)
- Clothoid spiral (circular arc section): build section (b-c)
- Tangent section (c-d)
- Clothoid spiral (circular arc section): drop section (d-e)
- Hold section (e-f)

In FIG. 4, the curvature bridging is smooth with clothoid spiral wellbore paths. Insertion of clothoid sections (a-b) and (d-e) will therefore, result in curvature continuity. This curvature bridge will alleviate the drag problems and will enable the design engineers to extend the reach of the well path with the given mechanical limitations. The tangents at the connection points between the clothoid spiral and the straight segments of the well path are the same. It has been discovered that the clothoid spiral reduces the lateral stresses on the tubulars that pass through the clothoid spiral section. Preferably, the clothoid spiral at the beginning of the build section should have the same curvature as its curvature that transitions to the beginning of the circular arc section. In the same manner, the clothoid spiral at the beginning of the drop section should have the same curvature as its curvature that transitions to the beginning of the hold section. Likewise, the end of the circular arc section of the clothoid spiral that transitions to the tangent section should have the same curvature as the curvature of the clothoid spiral that transitions to the beginning of the circular arc section. In other words, the clothoid spiral should end with the same curvature as the beginning or end of the tangent section.

Figure 5A:
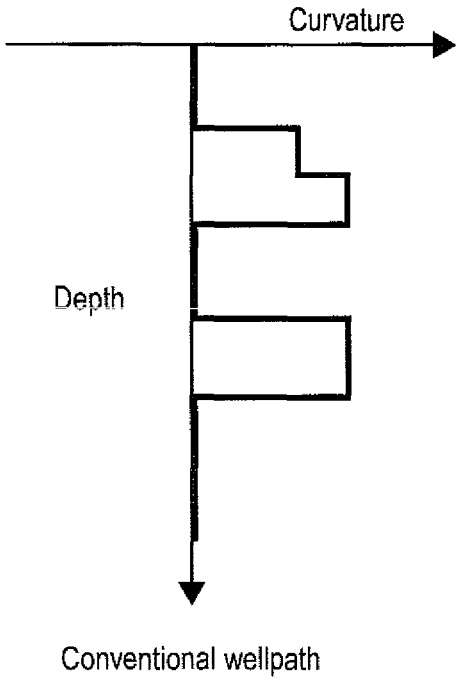
FIG. 5A is an illustration of another conventional well path design without clothoid spiral bridging curves.
Figure 5B:
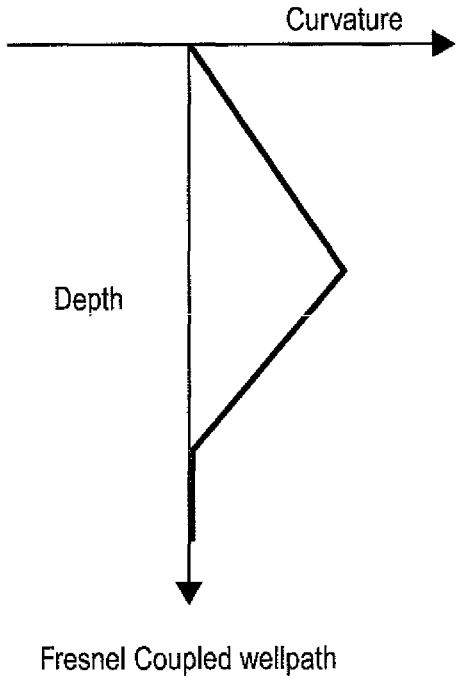
FIG. 5B is an illustration of the well path in FIG. 5A, which is designed with clothoid spiral bridging curves.

Referring now to FIG. 5A, another conventional well path design without clothoid spiral bridging curves is illustrated. In FIG. 5B, the well path in FIG. 5A is redesigned to illustrate the use of clothoid spiral bridging curves. It can be seen that the well path curvature in FIG. 5B, using a clothoid spiral bridging curve, is smother compared to the curvature of the well path using the conventional design illustrated in FIG. 5A.

Another mathematical criteria for measuring the borehole quality can be based on physical reasoning rather than the geometrical parameters of the well paths. The non-linear curve modeling of a thin elastic beam is known as the minimum energy curve and is characterized by bending the least while passing through a given set of points. It is considered to be excellent criteria, considering the simplicity for producing smooth curves. Thus, this criteria may be used to describe the minimum energy of a well path. An added advantage is that it may be used to emphasize the undulation of the well path curvature of sharp well path designs obtained from the conventional method.

A clothoid spiral is one of the least energy curves as described in Horn, B. K. P. The Curve of Least Energy, A. I. Memo 612, The Artificial Intelligence Laboratory Massachusetts Institute of Technology, Cambridge, Mass., December 1983, which is incorporated herein by reference.

The strain energy of the wellbore path is given as the arc length integral of the curvature squared:

$$E = \int_0^l \kappa(x)^2 \, dx \tag{12}$$

With the inclusion of the torsion parameter as the arc length integral of the torsion squared will make it more comprehensive and can be represented as:

$$E = \int_0^l (\kappa(x)^2 + \tau(x)^2) \, dx \tag{13}$$

This new concept may also be applied with clothoid spiral bridging curves to model wellbore trajectories and minimize the energy. In FIG. 5B, for example, the area under the curve between the well path and the vertical depth is much smaller than the area under the curve between the well path and the vertical depth in FIG. 5A. This results in minimum strain energy for the well path. Also, it can seen that the curvature results in FIG. 5B do not show the sharp change in the wellpath profile although the curvature and torsion derivative plots show the precise depth of the onset of change in the well path. This results in less torque, drag and bending stresses. The curvature and torsion squared data depicting the bending and torsional energy of the well path also show the area of unevenness and roughness in the well path as illustrated in FIG. 5B.

Method Description

Figure 6:
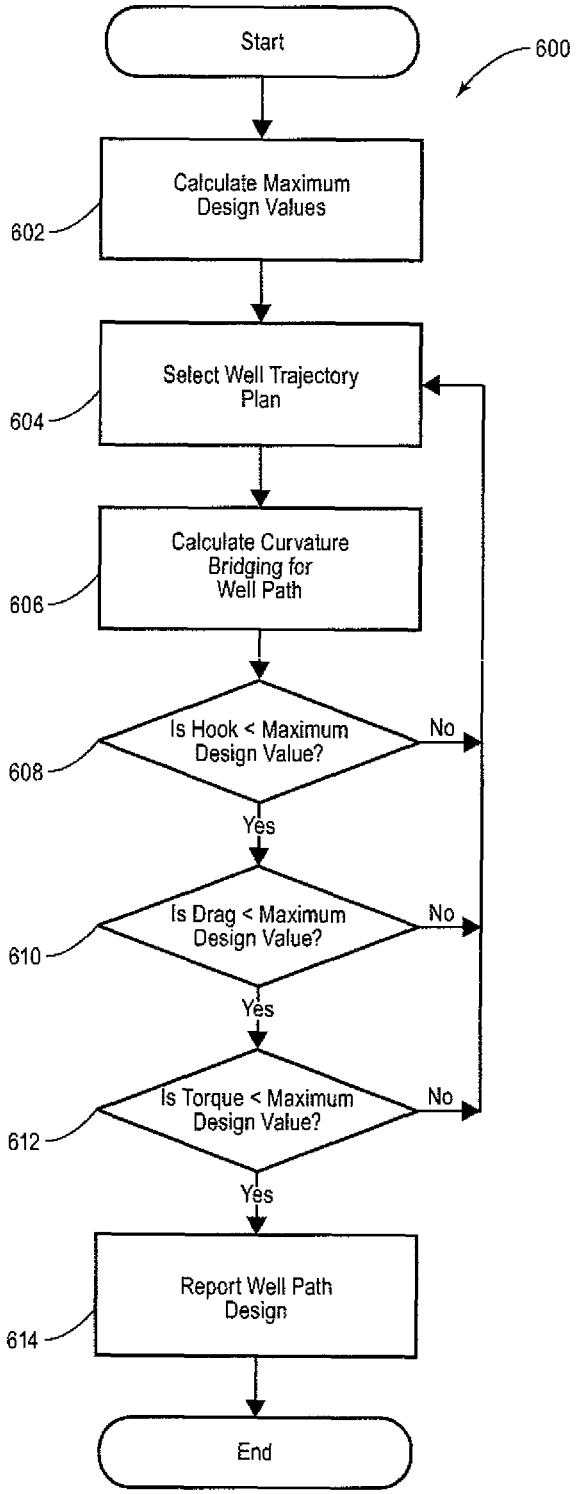
FIG. 6 is a flow diagram illustrating one embodiment of a method for implementing the present invention.

Referring now to FIG. 6, a flow diagram illustrates one embodiment of a method 600 for implementing the present invention.

In step 602, various maximum design values are calculated such as, for example, hook, drag and torque values using techniques well known in the art.

In step 604, a well trajectory plan is selected. The well trajectory plan may be selected from a variety of well trajectory plans such as, for example, S-type and J-type plans. A well trajectory plan may be selected based upon the requirements and reservoir conditions.

Figure 7:
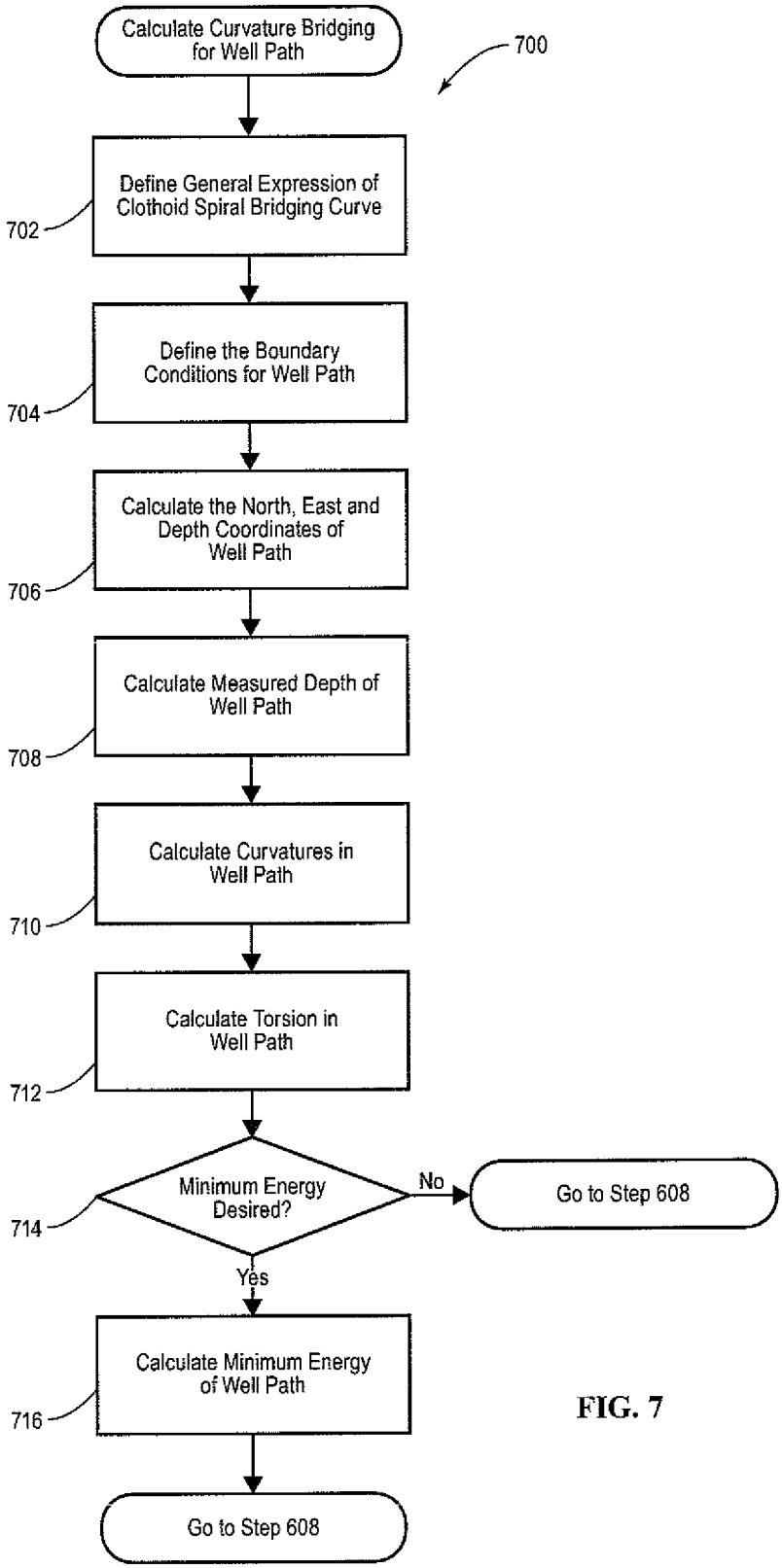
FIG. 7 is a flow diagram illustrating one embodiment of an algorithm for performing step 606 in FIG. 6.

In step 606, curvature bridging for the well path (well trajectory plan) is calculated according to the steps in FIG. 7. Curvature bridging for the well path may include, for example, calculated hook, drag and torque values, which may be compared against the maximum hook, drag and torque design values calculated in step 602.

In step 608, the hook value for the well path calculated in step 606 is compared against the maximum hook design value calculated in step 602. If the hook value calculated in step 606 is not less than the maximum hook design value calculated in step 602, then method 600 proceeds to step 604 where another well trajectory plan may be selected and the process repeated. If, however, the hook value calculated for the well path in step 606 is less than the maximum hook design value calculated in step 602, then the process proceeds to step 610.

In step 610, the drag value for the well path calculated in step 606 is compared against the maximum drag design value calculated in step 602. If the drag value calculated in step 606 is not less than the maximum drag design value calculated in step 602, then method 600 proceeds to step 604 where another well trajectory plan may be selected and the process repeated. If, however, the drag value calculated for the well path in step 606 is less than the maximum drag design value calculated in step 602, then the process proceeds to step 612.

In step 612, the torque value for the well path calculated in step 606 is compared against the maximum torque design value calculated in step 602. If the torque value calculated in step 606 is not less than the maximum torque design value calculated in step 602, then method 600 proceeds to step 604 where another well trajectory plan may be selected and the process repeated. If, however, the torque value calculated for the well path in step 606 is less than the maximum torque design value calculated in step 602, then the process proceeds to step 614.

In step 614, the well path design calculated in step 606 is reported since the design criteria (hook, drag, torque) do not equal or exceed the maximum design value for these criteria.

Referring now to FIG. 7, a flow diagram illustrates one embodiment of an algorithm 700 for performing step 606 in FIG. 6.

In step 702, a general expression for the clothoid spiral bridging curve may be defined by equations (3) through (5) to express the clothoid spiral in the form of equations (6) and (7) or (8) and (9) although other, well known, equations may be used to define the general expression for the clothoid spiral bridging curve.

In step 704, the boundary conditions for the well path are defined and may depend on the well path design. The boundary conditions may include, for example, free inclination and azimuth, set inclination and azimuth, free inclination and set azimuth or set inclination and free azimuth. Additional, well known, boundary conditions may be defined in step 704. Based on the boundary conditions and the position of the clothoid spiral bridging curve, the well path may be designed to meet a specified target.

In step 706, the North, East and depth coordinates of the well path may be calculated by:

$$\Delta N_i = \int_{L_i}^{L_{i+1}} \sin\alpha(L)\cos\phi(L)\,dL \tag{14}$$

$$\Delta E_i = \int_{L_i}^{L_{i+1}} \sin\alpha(L)\sin\phi(L)\,dL \tag{15}$$

$$\Delta D_i = \int_{L_i}^{L_{i+1}} \cos\alpha(L)\,dL \tag{16}$$

using the general expression for the clothoid spiral bridging curve in step 702 although other, well known, equations may be used to calculate the North, East and depth ("NED") coordinates of the well path. The clothoid equations from step 702 are used to calculate the NED coordinates in the respective clothoid section as well as other curved sections using the general direction cosine vector, which is given by the following equations:

$$c_N = \sin\alpha_s \cos\phi_s \tag{17}$$

$$c_E = \sin\alpha_s \sin\phi_s \tag{18}$$

$$c_D = \cos\alpha_s \tag{19}$$

In step 708, the measured depth of the well path may be calculated by:

$$\sum_{i=1}^{n} \Delta D_i = D_T \tag{20}$$

$$\sum_{i=1}^{n} \Delta H_i = H_T \tag{21}$$

using the general expression for the clothoid spiral bridging curve in step 702 although other, well known, equations may be used to calculate the measured depth of the well path. The incremental depth and the incremental horizontal departure coordinates are calculated using the clothoid equations from step 702 and well known rotation and translation transformation principles so that the curvature and torsion of the pre and post sections of the well path profile are aligned to prevent discontinuity in the curvature(s).

In step 710, curvatures in the well path, including the clothoid spiral section, may be calculated by:

$$\kappa(s) = \frac{\pi a}{\xi^2 + b^2} u \tag{22}$$

using the measured depth of the well path in step 708 although other, well known, equations may be used to calculate the curvature(s) in the well path. At each measured depth, which is obtained in step 708, along the well path, the respective positional curvature is calculated as are other sections of the well path profile. In equation (22), u, $\xi$, a and b are parameters wherein $\xi>0$ and $-\infty<b<+\infty$.

In step 712, torsion in the well path, including the clothoid spiral section, is calculated by:

$$\tau(s) = \frac{\pi b}{\xi^2 + b_2} u \tag{23}$$

using the measured depth of the well path in step 708 although other, well known, equations may be used to calculate the torsion in the well path. At each measured depth, which is obtained in step 708, along the well path, the respective positional torsion is calculated as are other sections of the well profile. In equation (23), u, ξ, a and b are parameters wherein $\xi>0$ and $-\infty<b<+\infty$. As the parameter u varies from $u=0$ and $u=2\pi$, the point on the clothoid spiral advances in the z direction a distance of $2\pi|b|$, and the x and y components return to their original values.

In step 714, the algorithm 700 determines if minimum energy calculations are desired in the well path design. If minimum energy calculations are desired then the process proceeds to step 716 where the minimum energy of the well path, including the clothoid spiral section, may be calculated using equations (12) and (13) although other, well know, equations may be used to calculate the minimum energy of the well path. The same parameters defined in the clothoid expressions are used to calculate the minimum energy of the well path profile along the wellbore at each incremental depth. Otherwise, the algorithm 700 proceeds to step 608 in FIG. 6.

After the minimum energy calculations are performed in step 716, the algorithm 700 proceeds to step 608 in FIG. 6.

Preliminary analysis with curvature bridging well path designs has been carried out and compared with conventional techniques for modeling wellbore trajectories. With the new model, it has been found that there is an appreciable reduction in the tubular stresses, axial force, tubular fatigue and surge reduction. It was discovered that a clothoid spiral bridging curve reduces the lateral forces on the tubulars that pass through the clothoid spiral section, which in turn will reduce the casing/tubular wear. The new design will also alleviate the drag problems and will enable design engineers to extend the reach of a well path with given mechanical limitations. Unlike prior wellbore trajectory models, the present invention provides bridging curves in the transition zones and may be used with other models, such as the standard torque-drag model, for the design of extended and ultra-extended reach well paths. The present invention also provides for a new wellbore trajectory model that is capable of bridging curves in the transition zones, reducing tubular stresses/failures, and can be used for designing multilateral well paths.

While the present invention has been described in connection with presently preferred embodiments, it will be understood by those skilled in the art that it is not intended to limit the invention to those embodiments. It is therefore, contemplated that various alternative embodiments and modifications may be made to the disclosed embodiments without departing from the spirit and scope of the invention defined by the appended claims and equivalents thereof.

The invention claimed is:

1. A well path, comprising:

a kick-off point;

a hold section; and a clothoid spiral between the kick-off point and the hold section, the clothoid spiral being based on:

one or more boundary conditions for the well path;

North, East and depth coordinates of the well path calculated using a general expression for the clothoid spiral; and a measured depth of the well path calculated using the general expression for the clothoid spiral.

2. The well path of claim 1, further comprising a build section positioned between the kick-off point and a tangent section, the build section including the clothoid spiral.

3. The well path of claim 1, further comprising a drop section positioned between the hold section and a tangent section, the drop section including the clothoid spiral.

4. The well path of claim 1, wherein the clothoid spiral includes a circular arc section.

5. The well path of claim 1, wherein the clothoid spiral reduces lateral stresses exerted on tubulars that pass through a clothoid spiral section of the well path constructed according to the well path design.

6. The well path of claim 2, wherein the clothoid spiral includes a curvature at a beginning of the clothoid spiral and another curvature at an end of the clothoid spiral, the curvature at the beginning of the clothoid spiral being the same as the curvature at the end of the clothoid spiral.

7. The well path of claim 6, wherein the clothoid spiral includes a circular arc section, the curvature at the beginning of the clothoid spiral being the same as a curvature at a beginning of the circular arc section.

8. The well path of claim 6, wherein the clothoid spiral reduces strain energy exerted on tubulars that pass through a clothoid spiral section of the well path constructed according to the well path design.

9. A method for designing a well path with a clothoid spiral, which comprises:

defining a general expression for the clothoid spiral using a computer processor;

defining one or more boundary conditions for the well path;

calculating North, East and depth coordinates of the well path using the general expression for the clothoid spiral;

calculating a measured depth of the well path using the general expression for the clothoid spiral;

calculating curvatures in the well path using the measured depth of the well path; and calculating torsion in the well path using the measured depth of the well path.

10. The method of claim 9, wherein the one or more boundary conditions comprise one of free inclination and azimuth, set inclination and azimuth, free inclination and set azimuth or set inclination and free azimuth.

11. The method of claim 9, further comprising calculating a minimum energy of the well path.

12. The method of claim 9, wherein the well path includes a kick-off point, a hold section and a clothoid spiral section.

13. A non-transitory program storage device tangibly carrying computer executable instructions for designing a well path with a clothoid spiral, the instructions being executable to implement:

defining a general expression for the clothoid spiral;

defining one or more boundary conditions for the well path;

calculating North, East and depth coordinates of the well path using the general expression for the clothoid spiral;

calculating a measured depth of the well path using the general expression for the clothoid spiral;

calculating curvatures in the well path using the measured depth of the well path; and calculating torsion in the well path using the measured depth of the well path.

14. The program storage device of claim 13, wherein the one or more boundary conditions comprise one of free inclination and azimuth, set inclination and azimuth, free inclination and set azimuth or set inclination and free azimuth.

15. The program storage device of claim 13, further comprising calculating a minimum energy of the well path.

16. The program storage device of claim 13, wherein the well path includes a kick-off point, a hold section and a clothoid spiral section.

17. A method for designing a clothoid spiral section for a well path, which comprises:

defining a general expression for the clothoid spiral section using a computer processor;

defining one or more boundary conditions for the well path;

calculating North, East and depth coordinates of the well path using the general expression for the clothoid spiral section; and calculating a measured depth of the well path using the general expression for the clothoid spiral section.

18. The method of claim 17, wherein the one or more boundary conditions comprise one of free inclination and azimuth, set inclination and azimuth, free inclination and set azimuth or set inclination and free azimuth.

19. The method of claim 17, further comprising calculating a minimum energy of the well path.

20. A non-transitory program storage device tangibly carrying computer executable instructions for designing a clothoid spiral section for a well path, the instructions being executable to implement:

defining a general expression for the clothoid spiral section;

defining one or more boundary conditions for the well path;

calculating North, East and depth coordinates of the well path using the general expression for the clothoid spiral section; and calculating a measured depth of the well path using the general expression for the clothoid spiral section.

21. The program storage device of claim 20, wherein the one or more boundary conditions comprise one of free inclination and azimuth, set inclination and azimuth, free inclination and set azimuth or set inclination and free azimuth.

22. The program storage device of claim 20, further comprising calculating a minimum energy of the well path.

* * * * *